United States Patent [19]

Heywang et al.

[11] 4,275,390

[45] Jun. 23, 1981

[54] BURGLAR ALARM DEVICE

[75] Inventors: Walter Heywang, Neukeferloh; Max Guntersdorfer, Zorneding; Peter Kleinschmidt, Munich, all of Fed. Rep. of Germany

[73] Assignee: Siemens Aktiengesellschaft, Berlin & Munich, Fed. Rep. of Germany

[21] Appl. No.: 780,806

[22] Filed: Mar. 24, 1977

[30] Foreign Application Priority Data

Mar. 31, 1976 [DE] Fed. Rep. of Germany ..... 2613845

[51] Int. Cl.[3] ..... G08B 13/16; G08B 13/18; G08B 29/00

[52] U.S. Cl. ..... 340/554; 343/5 PD; 343/6 R; 343/7.7; 367/94

[58] Field of Search ..... 340/16 R, 258 A, 258 B, 340/554, 560; 343/5 PD, 6 R, 7.7, 7 VM; 367/94

[56] References Cited

U.S. PATENT DOCUMENTS

| | | | |
|---|---|---|---|
| 3,074,053 | 1/1963 | McDonough et al. | 340/258 |
| 3,074,054 | 1/1963 | Pearson | 340/258 |
| 3,727,216 | 4/1973 | Antonio | 343/5 PD |
| 3,778,823 | 12/1973 | Sato et al. | 343/7 VM |
| 3,801,978 | 4/1974 | Gershberg et al. | 340/258 A |
| 3,846,778 | 11/1974 | Galvin et al. | 340/258 A |

*Primary Examiner*—John W. Caldwell, Sr.
*Assistant Examiner*—Joseph E. Nowicki
*Attorney, Agent, or Firm*—Hill, Van Santen, Steadman, Chiara & Simpson

[57] ABSTRACT

Burglar alarm apparatus includes an ultrasonic transmitter and an electromagnetic radiation transmitter whose signals are Doppler frequency shifted by an object moving through the radiation fields, the signals being received by respective demodulating receivers which provide respective electrical signals corresponding to the Doppler frequency. Frequency conversion apparatus is connected to one of the receivers to convert the output frequency thereof by a predetermined ratio to normalize or equalize the frequencies and a signal comparison circuit is provided to produce a signal in response to a ratio of the Doppler shifted signals within a predetermined tolerance range.

12 Claims, 3 Drawing Figures

BURGLAR ALARM DEVICE

BACKGROUND OF THE INVENTION

1. Field of the Invention

This invention relates to a burglar alarm device, and more particularly to such a device in which electromagnetic radiation and ultrasonic radiation are simultaneously emitted and Doppler frequency shifted in response to reflection by moving objects, and in which the Doppler frequency shifted reflections are detected and evaluated by a circuit which supplies a common evaluation signal when a ratio of the Doppler frequencies is determined within a prescribed tolerance range relative to a frequency ratio prescribed for the device, the ratio being determined by the reciprocal value of the wave length ratio of the emitted radiations.

2. Description of the Prior Art

It is known in the art to apply the Doppler principle in burglar alarms. In devices of this type, radiation is emitted by a transmitter and is reflected by objects, including people. The reflected radiation is picked up by a receiver and evaluated. If the reflection results from an object at rest, the frequency of the received radiation coincides with the frequency of the transmitted radiation. If, however, the reflection results from an object which is moving with a velocity component in the direction of the transmitter and/or the receiver, or away from the transmitter or receiver, then a Doppler frequency shift occurs in the received radiation.

Known burglar alarms, for example some of which are commercially available, utilize electromagnetic radiation in the X-band. The frequency utilized is, for example, about 9.5 GHz. Electromagnetic radiation of this type permits relatively good manipulation. It may be generated, for example, with a semiconductor Gunn diode; and the receiver is equipped, for example, with a Schottky diode. In individual cases at least, however, a device of this type which operates in the X-band has a particularly troublesome disadvantage, which is based on the characteristics of the electromagnetic radiation. More specifically, the electromagnetic radiation readily passes through walls, and particularly through windows; and when there is a reflection from a moving object, for example a person, it does not matter whether the person is moving in the area which is to be monitored with the device or, possibly, in an adjacent corridor, or also possibly, outside on the street. In order to remedy this disadvantage, a device of this type has been made so insensitive that it then, unfortunately, is no longer fully reliable for monitoring the desired area.

There are also burglar alarms available on the market which operate with ultrasonic radiation, for example in a frequency range of about 40 kHz, instead of with radio waves. An advantage of devices of this type is that, in comparison to devices operating with radio waves, they are technically less expensive and correspondingly less expensive to construct. Ultrasonic devices also have special disadvantages, however. One particular disadvantage is that the transmitted ultrasonic radiation is also influenced, for example, by moving air, for instance by attenuation fluctuations. Particularly in heated areas, however, air turbulence cannot be precluded. In order to avoid false alarms, the method selected in this case as well was to make the device very insensitive. On the other hand, for these and other reasons, ultrasonic devices have practically only been used for monitoring smaller areas, such as vehicles and mobile homes.

U.S. Pat. No. 3,846,778 discloses a burglar alarm device in which not only electromagnetic radiation, but also ultrasonic radiation is used for the detection of a moving object, this device, however, is constructed in such a manner that the radio waves are used for one monitoring zone and the ultrasonic waves for another, different monitoring zone. An alarm is provided when an intrusion is detected in either of the zones. Coincidence for a reaction of the section operating with electromagnetic radiation is not provided and is not a particularly good concept in that case, it cannot be carried out. In order to achieve a simplification for both sections of such a device, namely to be able to use one and the same electronic evaluation circuit for the radio wave section and for the ultrasonic wave section, it is provided that the frequencies of the radio wave and the ultrasonic wave are tuned to each other in such a way that both types of radiation have equal wave lengths in air.

British Pat. No. 1,386,233 discloses a burglar alarm device in which one section operates with electromagnetic radiation and another section operates with ultrasonic waves. In this device it is provided that an alarm is given only when there is coincidence, namely when an occurrence which is to be reported is simultaneously detected in both device sections. In this known device, the two sections are individually operated and are connected together at their outputs for signal emission.

In the device disclosed in the British patent, it is not guaranteed that a reaction of both sections is due to reflection from the same identical object. This device would, in particular, trigger an alarm if, for example due to the healing or ventilating system there is a movement of curtains, or even only an air turbulence in the monitored area, and simultaneously, outside of that area, for example in an exterior corridor, a person walks by the monitored area. As set forth above, ultrasonic radiation reacts to moving curtains and the like. Electromagnetic radiation, for its part, is easily capable of penetrating even a masonry wall, so that the object detected with electromagnetic radiation need not have appeared in the monitored zone at all.

A device similar to the structure disclosed in the aforementioned British patent is described in U.S. Pat. No. 3,727,216. In this device, a section operates with electromagnetic radiation and another section operates with an ultrasonic radiation and the sections are connected together with respect to coincidence. The ultrasonic section involves a complete device which emits a signal as its output when an output voltage signal exceeds a predetermined threshold value. With this signal, which does not contain information concerning the velocity of the originally detected, moving objects, an AND gate is controlled in such a manner that only when this threshold value signal is present does the AND gate permit a Doppler frequency signal of the electromagnetic radiation section pass through to an evaluation circuit. Even in this burglar alarm device, it is not guaranteed that the coincidence is due to a reflection from the same identical object. Here as well, the reaction of the ultrasonic section may be due to a moving curtain and the reaction of the electromagnetic radiation section can be caused by a person moving outside of the monitored area. Such a coincidence of two different occurrences is in no way infrequent.

SUMMARY OF THE INVENTION

An object of the invention, therefore, is to provide a burglar alarm device which has high reactive sensitivity and great security with respect to false alarms, and in particular, to a burglar alarm device which guarantees that a detected coincidence is not based on two different events, which in practical situations can certainly occur simultaneously. In addition, the device is to be further developed, in the case of particular need, in such a manner that it is insensitive to intentional disruptions such as could be carried out by a person who has very detailed technical knowledge of such devices. It should be borne in mind in this regard that such a case of need is probably only relevant for extremely important objects. The above objective is accomplished in a device of the type mentioned above in that, in order to guarantee that the electrical signals occurring in a respective reflection are based on respective Doppler frequency shift reflections from the same object, the electronic apparatus for detecting and evaluating the reflected signals only supplies a common evaluation signal if and when a ratio of the Doppler frequencies of the respective electromagnetic and ultrasonic sections is determined with a prescribed tolerance range and relative to a frequency ratio which is predetermined for the device, where the ratio is determined by the reciprocal value of the wave length ratio of the emitted radiations.

The invention has the underlying principle of constructing a burglar alarm in such a way that the principles of the two devices mentioned above and known in the prior art are utilized in combination. In such a device, two radiation monitoring branches are provided, namely a branch which operates with radio waves and a branch which operates with ultrasonic waves. According to the invention, this device can easily be adjusted to the high, obtainable sensitivity, without false alarms being triggered in that the device only reacts to a coincidence of the reaction of both the radio wave branch and the ultrasonic wave branch. A person moving, for example, outside of the boundary wall of the monitored area would, to be sure, be registered by the branch which operates with radio waves; then there is no simultaneous signal in the ultrasonic wave branch in that the ultrasonic waves are, at least practically, unable to penetrate beyond the region of the boundary wall. On the other hand, the radio wave section would not, in any case, react to air movements or moving curtains, which would per se cause a reaction in the ultrasonic branch.

According to a particularly favorable embodiment of the invention, it is provided that the wave length of the radio waves in air and the wave length of the ultrasonic radiation in air are of equal magnitude. The result is that, because of its Doppler velocity component in effect relative to the transmitters for the radio waves and the ultrasonic waves, one and the same object generates equal Doppler shifts for the radio waves and the ultrasonic waves. The coincidence detector then only needs to react to the simultaneous occurrence of one and the same Doppler frequency in the radio wave branch and in the ultrasonic wave branch of the device. It should be noted that the two transmitters for the radio waves and the ultrasonic waves and the corresponding receivers are respectively located at least essentially in one place, so that the same velocity component of the moving object is, in effect for both types of radiation. A comparison of the two Doppler shifted frequencies of the received radio waves and the received ultrasonic waves can then be carried out according to the beat principle which is per se well known in the art.

If, however, the reflected radiation comes from respectively different moving objects for both branches, for example from a moving curtain present in the monitored zone of the ultrasonic radiation, and from a passerby walking in front of a window of the monitored room, in the case of radio waves, then, in the two branches, differently large Doppler shifts of the received frequency are determined, except for the practically completely improbable case that the two different objects were to move with equal velocity component relative to the transmitters and/or receivers.

The concept of utilizing equal wave lengths for both radiations is based on the realization that, for the frequency $f_D$ of the Doppler shift, what matters is the temporal wave length alteration as a result of the movement of the reflecting object.

Equal wave lengths in air are achieved, for example, for a radio wave frequency of 19 GHz and an ultrasonic frequency of 20 kHz, whereby the audibility range must be taken into consideration for the lower limit of the ultrasonic frequency. It would be more advantageous if a relatively lower radio frequency could be used. This is, in point of fact, also readily possible with the present invention. The invention may be realized with particular advantage, for example, with 40 kHz as the ultrasonic frequency and 9.5 GHz for the radio wave frequency, whereby a ratio n of 1:4 results for the wave lengths of the ultrasonic and radio wave radiation. The ratio of the frequencies $f_D$ of the Doppler shift is then inversely proportional for the ultrasonic waves and the radio waves. A frequency comparison is nevertheless possible in a simple manner in that the higher Doppler frequency is dividedd down and/or the lower Doppler frequency is multiplied, so that the result for a Doppler shift arising from one and the same moving object, is the frequency ratio 1:1, which is then fed to a product detector. Advantageously, integral ratios n will be used for the wave lengths, or, respectively, frequencies of the ultrasonic radiation and the electromagnetic radiation. However, ratios n in the magnitude of rational fractions can also be used, for which purpose a correspondingly reciprocal frequency multiplication or, respectively, division is then performed.

However, in the case of a prescribed ratio of the wave lengths of the ultrasonic radiation and the radio wave radiation to one another, the invention may also be realized with other electronic means. It is recommended, for example, to use a phase locked loop (PLL) circuit. Details of these types of circuits may be obtained, for example, from the book "Signetics", Integrated Circuits, Section B, Applications. What is involved here is a circuit which has a product mixer and an oscillator. An input signal and a signal of the oscillator are fed into the product mixer. The output signal of the product mixer is fed back to the oscillator by way of a regulator loop in order to adjust the oscillator in frequency and phase to the frequency and phase of the input signal which is being fed to the product mixer. If, for example, a PLL circuit of this type is used in the ultrasonic branch of the receiver, and the Doppler frequency signal which has been demodulated by the ultrasonic Doppler detector is fed to the PLL circuit, then the oscillator of the PLL circuit is always adjusted to this Doppler frequency. A second oscillator is coupled to this fine tuning PLL circuit from which a mixing signal is applied to a product mixer of the radio wave range. In addition, the Doppler frequency signal of this branch which has been demodulated by the radio wave Doppler detector is fed to the product mixer of the radio wave section. As to frequency, this second oscillator is different from the oscillator of the PLL circuit by the aforementioned prescribed ratio n.

The second oscillator thus supplies a frequency, which is different by the prescribed ratio n, to the product mixer of the radio wave section. In case the received signals of the two branches arise from one and the same moving object, then, because of the effect of the PLL circuit, coincidence for both branches is determined and an alarm is correspondingly provided.

An advantageous further development of the invention resides in the provision of measures with which it is possible to prevent an unauthorized person, for example a burglar, from being able to circumvent the burglar alarm. A circumvention would be possible in that, with an external transmitter—in normal cases this will also be an ultrasonic transmitter—, radiation is beamed into the receiver of the device constructed in accordance with the present invention, which radiation has such a great intensity that the respective branch, for example the ultrasonic branch, is "stopped-up", so to speak, with a foreign frequency, i.e. it is rendered non-functional for the reception of a Doppler signal which would result from a moving object. This disruptive, beamed-in frequency—relative to the frequency of the transmitter of the device—would then be demodulated as a Doppler signal by the receiver of the respective branch; and an apparent velocity would be assigned to the frequency $f_D$ thereof, which velocity is in normal cases different from the Doppler frequency $f_D$ or, respectively, the velocity which is properly detected in the other branch, for example the radio wave branch, on the basis of the reflection from the moving object—the moving burglar. In a device constructed in accordance with the present invention, it will be determined that no coincidence exists, namely because it is completely unable to detect the genuine Doppler signal of the other branch because of the overloading in this branch or, respectively, next to the much greater disruptive signal.

According to a further development of the invention, it is therefore provided that whenever an excessively large signal is received by at least one of the branches, an alarm is triggered, independently of coincidence. The threshold for this alarm triggering is selected sufficiently high that it is higher, in any case, than a signal strength which would correspond to normal reception intensities which can arise in the most extreme case during normal operation of the device. This further development of the invention can be constructed in such a manner that, even with an intentional jamming radiation with exactly the transmission frequency of a receiver branch, i.e. apparently no Doppler shift occurs in that case, an alarm is triggered because of the excessive strength of the received signal. The present invention would then be secure in a case in which someone, for example during the day, when the device is naturally deactivated, renders the device inoperative for a time when it is turned on, by placing a motionless wall close in front of the device, because the device is, on the one hand, then impeded in the transmission of radiations into the entire area and, on the other hand, would only detect reflections from a motionless wall. A wall standing close in front of the device would then, however, supply such a strong reflection intensity, which would be above the threshold value of a detector connected to that branch that an alarm would be triggered.

It is of practical advantage to only provide one frequency range for the detection of the Doppler frequency. This may be achieved in a simple manner with a band pass filter. By this means, Doppler frequencies are then excluded from detection when the frequencies are based on velocities which—for whatever reasons—are not of interest. Thus, the reception of the intrinsic frequency of the respective transmitted radiation is also excluded.

It is also of particular advantage to provide a tolerance range k for comparison of the Doppler frequencies or, respectively, for the ratio of the Doppler frequencies of the two branches of a device constructed in accordance with the invention. First of all, this structure serves to balance out or compensate somewhat different frequencies $f_{DUS}$ and $f_{DX}$ which occur because of somewhat different transmission and reception directions, based on somewhat different components of the Doppler velocity of the same moving object. In addition, a higher reaction speed can thus be achieved, which also depends on the transient response of the receiver parts, including the filters. The tolerance width k for the frequency difference or, respectively, for the difference of the actual ratio from the prescribed ratio n of the Doppler frequencies of the two branches may not, however, be dimensioned so large that simple occurrence coincidence exists, which need not be based on reflection from one and the same object. The tolerance width k may be adjusted by corresponding dimensioning of an output side low pass filter.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
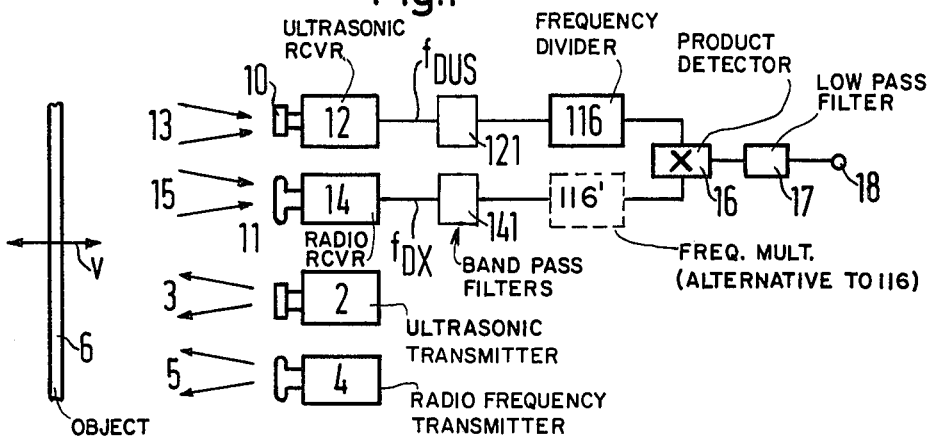
FIG. 1 is a schematic block diagram of one embodiment of a burglar alarm constructed in accordance with the principles of the present invention and having a frequency division in one of the receiving branches.

Referring to FIG. 1, an ultrasonic transmitter having an associated emission transducer is generally referenced 2. A radio wave transmitter, together with its dipole antenna, is generally referenced 4. The transmitters 2 and 4 transmit ultrasonic and radio wave radiation, respectively, as indicated by respective arrows 3 and 5. Reflected portions of the radiations 3 and 5 are indicated by respective arrows 13 and 15. The reflected portions of the waves are received by the receiving transducer 10 or, respectively, by the antenna 11 and are fed to an ultrasonic receiver 12 or, respectively, to a radio wave receiver 14. To the extent that the received portions indicated by the arrows 13 and 15 are based on the reflection of an object 6, which is moving with a Doppler velocity component v, Doppler frequency shifted signals are received by the receivers 12 and 14.

In the receivers 12 and 14 demodulators are contained which cause signals to occur at the respective outputs of the receivers 12 and 14, which signals correspond to the Doppler frequency. At the output of the receiver 12, which belongs to the ultrasonic wave branch of the burglar alarm apparatus, this output signal is designated $f_{DUS}$. At the output of the receiver 14, which belongs to the radio wave section of the burglar alarm apparatus, the output signal is designated $f_{DX}$. Let it be assumed, in the example illustrated in FIG. 1, that the wave length of the ultrasonic radiation 3 emitted by the transmitter 2 is four times as short as the radio wave radiation 5 emitted by the transmitter 4. With a Doppler frequency shift based on an equal Doppler velocity v, in each case, the Doppler frequency $f_{DUS}$ is then four times greater than the Doppler frequency $f_{DX}$ of the radio wave section. In order to bring this prescribed frequency ratio n to the value 1:1 for the subsequently connected product detector 16, a divider 116 with a division ratio of 4:1 is inserted into the ultrasonic section. The output signal of the product detector 16 is then fed, as an evaluation signal, to an output 18, by way of a low pass filter 17.

The upper limiting frequency of the low pass filter 17 is advantageously dimensioned in such a way that the prescribed tolerance width or range k for the frequency comparison of the two Doppler frequency signals $f_{DUS}$ and $f_{DX}$ is achieved; and, in this manner, a tolerance width for the Doppler velocity v initially separately detected by the individual sections is achieved. The tolerance width is preferred to be ±(1% to 10%) of the ratio of the difference of the Doppler frequencies to either of the Doppler frequencies. For an ideal frequency match, a direct current signal results at the output connection 18 for the existence of coincidence, which signal is applied for triggering an alarm.

As specifically set forth above, the receivers 12 and 14 have respective band pass filters 121, 141 connected at their outputs, as is clearly set forth on the drawing, with which the frequency range for the Doppler frequency signals $f_{DUS}$ and $f_{DX}$ and thus for the detection of velocities of a reflecting object can be limited, vis-a-vis higher and lower velocities which are not to be detected in that they are not of interest.

Figure 2:
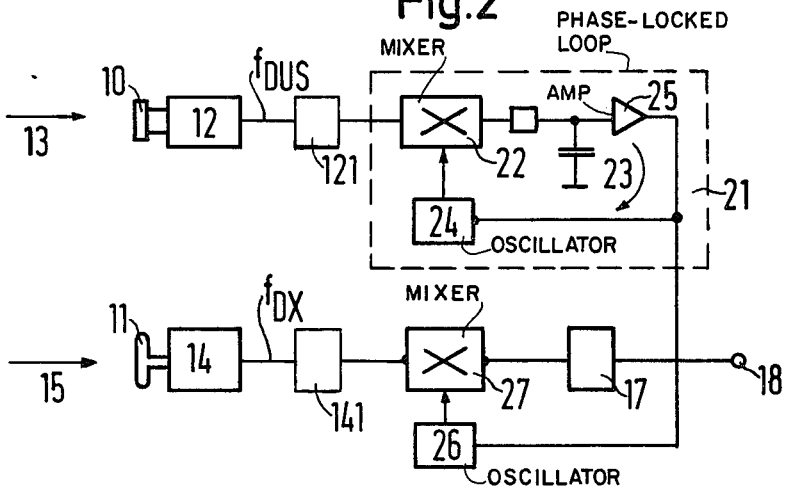
FIG. 2 is a block circuit diagram of another embodiment of the invention illustrating a different type of frequency comparison.

Referring to FIG. 2, only the receiver of an embodiment of the invention is illustrated, in contrast to the transmitter and receiver illustrations of FIG. 1. In FIG. 2, the same elments as found in FIG. 1 are similarly referenced with the characters 10, 11, 12, 14, 121 and 141 as in FIG. 1. The signal of the frequency $f_{DUS}$ is fed to a PLL circuit 21, more specifically to a mixer 22 contained therein. The output signal of the mixer 22 is fed, via the phase locked loop 23, to an oscillator 24 by way of an amplifier 25. In this manner the usual PLL circuit control of the oscillator 24 is achieved, as well known to those skilled in the art. The output of the oscillator 24 is fed to the mixer 22 with a frequency matching the frequency $f_{DUS}$. As can be seen in FIG. 2, a second oscillator 26 is connected to and controlled by the PLL circuit 21. The natural frequencies of the oscillators 24, 26 differ by the factor n of the predetermined ratio for the Doppler frequencies. The mixing of the output signal of the oscillator 26 with the output signal $f_{DX}$ of the receiver 14 is carried out in a mixer 27. Because of the coupling of the oscillator 26 and the attendant frequency control thereof with the frequency $f_{DUS}$, the output of the mixer 27 directly supplies the mixing product of the two frequencies $n \cdot f_{DUS}$ and $f_{DX}$ by way of the low pass filter 17 to the output 18 for evaluation of this mixing product.

Figure 3:
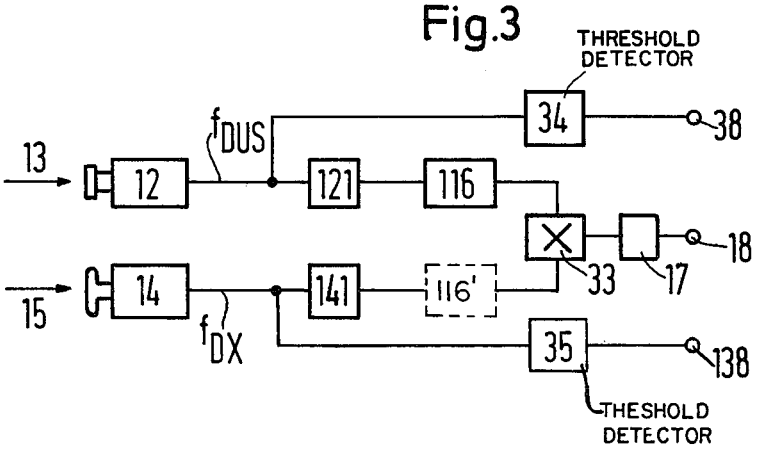
FIG. 3 illustrates an embodiment of the invention, in block diagram form, in which the burglar alarm has anti-jamming protection.

As in FIG. 2, FIG. 3 also only illustrates the receiver of the burglar alarm and specifically in a scope which is more restricted with respect to the fundamental aspect. Details described above in connection with FIGS. 1 and 2 are referenced with the same characters in FIG. 3 and require no further explanation. In the embodiment according to FIG. 3, separate band pass filters 121, 141 are provided in the individual sections for the upper and lower frequency limitation of the Doppler frequency signal. A frequency comparator, which is only diagrammatically illustrated, is referenced 33. The output of the comparator 33 feeds a signal to the output 18 for evaluation and/or use as an alarm signal. A pair of threshold detectors 34 and 35 are illustrated in FIG. 3 and are connected in the circuit in the respective sections to the outputs of the receivers 12 and 14 containing the Doppler frequency demodulators, which receivers feed the respective band pass filters 121, 141. It is thus avoided that the signal to be evaluated by the threshold value detector 34, or the threshold value detector 35, is otherwise possibly attenuated by a band pass filter so that it can no longer be recognized as representing reflections excessive intensity. The threshold value detectors 34 and 35 have respective outputs 38 and 138 for providing independently effective signals for triggering an alarm in response to excessive reflections of the type mentioned in the introductory portion of the specification.

The signals occurring at the output connection 18 and, if the occasion arises at the output connections 38 and 138, are fed to an alarm device which is known per se and which is not illustrated on the drawing. In an embodiment of the invention according to FIG. 3, a signal at the output 18 corresponds to a reaction of the device to a moving object, for example to the entry of a burglar. A signal at the output connection 38, or at the output connection 138, denotes an intentional jamming of the device, as was more specifically set forth above.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. Burglar alarm apparatus with transmitters for electromagnetic and for ultrasonic radiation respectively and with receivers for reflected electromagnetic radiation and ultrasonic radiation reflected respectively, which reflected radiations are Doppler shifted by an object moving through the radiation fields, comprising:

a demodulating electromagnetic radiation receiver for receiving the electromagnetic radiation and providing electrical signals corresponding to the Doppler frequency of the electromagnetic radiation;

a demodulating ultrasonic receiver for receiving the ultrasonic radiation and providing electrical signals corresponding to the Doppler frequency of the ultrasonic radiation; and signal comparison means connected to both of said receivers and operable to produce a signal in response to the ratio of the Doppler frequency signals being determined within a predetermined tolerance width to indicate that the two Doppler frequency signals are reflected by the same object.

2. The apparatus of claim 1, wherein said signal comparison means comprises means for defining the tolerance within the range of ±(1% to 10%) of the difference in said Doppler frequencies divided by either Doppler frequency.

3. The apparatus of claim 1, comprising in combination, an electromagnetic radiation transmitter and an ultrasonic radiation transmitter at the same location as said receivers.

4. The apparatus of claim 1, wherein each of said receivers includes a transducer adjacent the transducer of the other receiver.

5. The apparatus of claim 1 further comprising a frequency conversion means connected between one of said receivers and said signal comparison means to convert the output frequency of said one receiver by a predetermined ratio to equalize the frequencies of the Doppler signals.

6. The apparatus of claim 5, wherein said frequency conversion means is a frequency multiplier.

7. The apparatus of claim 5, wherein said frequency conversion means is a frequency divider.

8. The apparatus of claim 1, wherein said comparison means comprises a low pass filter as an output stage defining the predetermined tolerance width for achieving comparison of the two doppler frequency signals.

9. The apparatus of claim 5 comprising:

a phase locked loop circuit connected to the other of said receivers, including a first oscillator; and said frequency conversion means comprises a second oscillator connected to said first oscillator and controlled thereby to oscillate at a frequency according to the predetermined ratio.

10. The apparatus of claim 1, comprising:

first and second threshold detectors, each connected to a respective receiver and each providing a respective separate output for further evaluation signals.

11. The apparatus of claim 1, comprising:

a pair of band pass filters connected to respective outputs of said receivers to pass the Doppler signals and reject higher and lower frequency signals.

12. Burglar alarm apparatus with adjacent transmitters for electromagnetic and for ultrasonic radiation respectively and with receivers for reflected electromagnetic radiation and reflected ultrasonic radiation respectively, which reflected radiations are Doppler shifted by an object moving through the radiation fields, comprising:

an antenna;

a demodulating electromagnetic radiation receiver connected to said antenna for receiving the electromagnetic radiation and providing electrical signals corresponding to the Doppler frequency of the electromagnetic radiation;

an ultrasonic transducer;

a demodulating ultrasonic receiver connected to said transducer for receiving the ultrasonic radiation and providing electrical signals corresponding to the Doppler frequency of the ultrasonic radiation;

frequency conversion means connected to the output of one of said receivers to convert the output frequency thereof by a predetermined ratio to equalize the frequencies of the Doppler frequency signals;

signal comparison means connected to the other of said receivers and to said frequency conversion means and operable to produce a signal in response to the ratio of the Doppler frequency signals being within a predetermined tolerance width to indicate that the two Doppler signals are reflected by the same object;

the transducer of said ultrasonic radiation receiver being adjacent the antenna of said electromagnetic radiation receiver;

said comparison means comprising means for defining the tolerance within the range of ±(1% to 10%) in accordance with the ratio of the differenced in the Doppler frequencies to either of the Doppler frequencies.

* * * * *